US011365643B2

(12) United States Patent
Sebrecht et al.

(10) Patent No.: US 11,365,643 B2
(45) Date of Patent: Jun. 21, 2022

(54) ROTOR DISC SEALING FLANGE SECTOR

(71) Applicant: SAFRAN AIRCRAFT ENGINES, Paris (FR)

(72) Inventors: Pierre-Alain Francis Claude Sebrecht, Paris (FR); Nishanth Thomas Rajaratnam, Lieusaint (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 79 days.

(21) Appl. No.: 16/741,583

(22) Filed: Jan. 13, 2020

(65) Prior Publication Data

US 2020/0224543 A1 Jul. 16, 2020

(30) Foreign Application Priority Data

Jan. 15, 2019 (FR) ..... 1900365

(51) Int. Cl.
*F01D 11/00* (2006.01)

(52) U.S. Cl.
CPC ..... *F01D 11/006* (2013.01); *F05D 2240/55* (2013.01)

(58) Field of Classification Search
CPC ..... F01D 5/326; F01D 5/3015; F01D 11/006; F04D 29/322
See application file for complete search history.

(56) References Cited

U.S. PATENT DOCUMENTS

| | | | | |
|---|---|---|---|---|
| 5,662,458 | A * | 9/1997 | Owen | F01D 5/3015 416/145 |
| 7,217,100 | B2 | 5/2007 | Benderradji et al. | |
| 7,850,430 | B2 | 12/2010 | Cloarec | |
| 9,033,666 | B2 | 5/2015 | Bosco | |
| 2011/0163506 | A1* | 7/2011 | Hafner | F01D 5/323 277/309 |
| 2011/0311366 | A1* | 12/2011 | Chanteloup | F01D 5/326 416/220 R |

(Continued)

FOREIGN PATENT DOCUMENTS

| | | |
|---|---|---|
| EP | 1498579 A1 | 1/2005 |
| EP | 1895103 A2 | 3/2008 |

(Continued)

OTHER PUBLICATIONS

Search Report dated May 12, 2020, received in corresponding British Application No. GB2000602.9, filed Jan. 15, 2020, 1 page.

(Continued)

*Primary Examiner* — Christopher Verdier
*Assistant Examiner* — Cameron A Corday
(74) *Attorney, Agent, or Firm* — Christensen O'Connor Johnson Kindness PLLC

(57) ABSTRACT

A sealing flange sector for a turbomachine rotor disc includes a radially outer part which is configured to bear at least partly against blades of the turbomachine rotor disc to ensure sealing between the blades and a radially inner part configured to bear on an annular strip mounted on a face of the turbomachine rotor disc, the radially inner part having a first groove disposed radially outwardly of a second groove. The first groove includes at least one foolproofing element.

20 Claims, 2 Drawing Sheets

(56) References Cited

U.S. PATENT DOCUMENTS

| | | | | |
|---|---|---|---|---|
| 2013/0272886 | A1* | 10/2013 | Dimmick, III ..... | F01D 11/006<br>416/220 R |
| 2013/0323067 | A1* | 12/2013 | Antonellis ..... | F01D 5/3015<br>416/223 R |
| 2014/0193265 | A1 | 7/2014 | Adenis et al. | |

FOREIGN PATENT DOCUMENTS

| | | | |
|---|---|---|---|
| FR | 2913064 | A1 | 8/2008 |
| FR | 2969209 | A1 | 6/2012 |
| GB | 1295003 | A | 11/1972 |
| WO | 2011/092439 | A1 | 8/2011 |

OTHER PUBLICATIONS

Rapport De Recherche Preliminaire and Opinion dated Sep. 26, 2019, for French Application No. 1900365, filed Jan. 15, 2019, 8 pages.

* cited by examiner

ROTOR DISC SEALING FLANGE SECTOR

CROSS REFERENCE TO RELATED APPLICATION

This application claims priority under 35 U.S.C. § 119 to French Patent Application No. 1900365, filed Jan. 15, 2019, which is herein incorporated by reference in its entirety.

TECHNICAL FIELD OF THE INVENTION

Embodiments of the present disclosure relate to aeronautical turbomachines, for example a sealing flange sector for a turbomachine rotor disc. It also relates to an annular flange equipped with such a sealing flange sector, a rotor disc comprising such a flange, and a turbomachine comprising such a rotor disc.

BACKGROUND

The prior art includes patent documents U.S. Patent Application Publication No. 2014/0193265, European Patent Application Publication No. 1895103, European Patent Application Publication No. 1498579 and International Patent Publication No. WO 2011/092439.

In general, some turbomachine rotor discs with blades, such as compressor or turbine discs, are equipped with a sealing system to prevent air flow leakage at the blade roots. In particular, the rotor discs, centered on a longitudinal axis of the turbomachine, comprise a plurality of cavities evenly distributed over their periphery. The cavities each have a main direction parallel to the axis of the turbomachine and the blade roots are each housed in a cavity. This arrangement is known as the "axial attachment" or "pinned attachment." The clearance between the blade roots and the disc cavities, together with the axial forces of the aerodynamic flow passing through the compressor or turbine on the blades which exerted over the blades, allow unwanted airflow to pass on either side of the root of the blades. These leaks lead to airflow recirculation, resulting in significant losses in turbine or compressor performance and flow rate. The sealing system is configured to compensate for these leaks and air flow recirculation.

An example of a sealing system, known from French Patent No. 2913064, comprises several circumferentially juxtaposed flange sectors. Each flange sector comprises a radially outer part and a radially inner part. Each flange sector is movable by centrifugal effect between a rest position in which its radially inner part bears against a hub of the disc and an operating position in which its radially outer part is applied to the disc (more precisely the blading) to prevent leakage of pressurized air flows towards the axis of the disc and upstream thereof. In addition, the radially inner part of the flange comprises a first annular groove arranged radially outside a second annular groove. An annular sealing strip is configured to be mounted in the second groove and to bear against a downstream face of the rotor disc hub. This annular sealing strip makes it possible, on the one hand, to keep the annular flange or several flange sectors cold and, on the other hand, to clamp the flange radially during operation under the effect of centrifugal force and to tilt them around disc hooks, thus ensuring complete sealing.

When the sealing system is mounted by an operator, the sealing strip is first mounted on one face of the rotor disc, followed by the individual sealing flange sectors by sliding and making the annular strip fit into the second groove of each flange sector. Finally, the blades are mounted on the rotor disc with their roots in the cavities. However, the geometry of both the first and second grooves is essentially identical and their configuration, especially sufficiently close to each other at the radially inner groove, make that the operator can inadvertently fit the annular strip without obstacle into the first groove, which is not intended for this purpose. Such a mounting error leads to a leakage of the flange sectors. This is due to the fact that the annular strip, which is now mounted in the first groove, is located at the bottom of the cavities with a radial gap between the annular strip and the bottom of the cavities. The air flow can thus flow through this radial space, towards the disc axis and upstream of the rotor disc, passing again under the blade roots. An area with fins is located on one or both sides of the rotor disc, these fins cooperating with a layer of abradable material. Leakage of the air flow can lead to an increase in the temperature of this fins area and irreversible plastic deformation of the fins, which can lead to cracks or crevices in the fins due to the strong penetration of the fins into the abradable material opposite them.

The present disclosure provides simple and effective solutions for mounting an annular strip cooperating with at least one flange sector at the right place and for the flange sector to be able to ensure its sealing function.

SUMMARY

In an aspect, the present disclosure provides a sealing flange sector for a turbomachine rotor disc which carries blades, the annular flange sector comprising a radially outer part which is configured to be applied at least partly on the blades in order to ensure sealing between the blades and a radially inner part configured to bear against an annular strip mounted on one face of the rotor disc, the radially inner part comprising a first groove arranged radially outside a second groove, the first groove comprising at least one foolproofing element.

This foolproofing element in the first groove prevents the operator from inserting an organ of the turbomachine, such as an annular strip of a sealing system in this first groove which is not configured to receive it, and consequently the risks of leakage of aerodynamic flow through the flange are limited. In other words, the operator will not be able to insert the annular strip in the first groove because of this foolproofing element. This solution guarantees the mounting of the flange sectors on the disc and is easy to implement.

In some embodiments, the flange sector also comprises one or more of the following features, taken alone or in combination:

- the first groove comprises two opposite ends along a circumferential direction of elongation of the first groove, a foolproofing element being arranged at at least one of the two circumferential ends of the first groove;
- a foolproofing element is arranged respectively at each end of the first groove;
- each foolproofing element comprises (and in some embodiments, consists of) a protuberance projecting from a bottom of the first groove;
- the protuberance is integrally formed with the flange sector;
- the radially outer part comprises a peripheral lip configured to come against at least one blade root;
- the flange sector comprises a plurality of lugs arranged radially between the radially inner part and radially outer part, each lug extending radially outwardly;

the first groove and the second groove are arranged on an upstream face of the flange sector;

the first and second grooves are radially separated by an annular projection extending axially from the upstream face of the flange sector;

the flange sector is made of a metallic material or a metallic alloy.

In another aspect, the present disclosure provides an annular flange comprising a plurality of flange sectors having any one or more of the foregoing characteristics.

In another aspect, the present disclosure provides a turbomachine rotor disc carrying blades and equipped with an annular flange having any one or more of the above-mentioned characteristics and with an annular sealing strip installed in the second groove of each flange sector.

In another aspect, the present disclosure provides a turbomachine comprising a rotor disc having any one or more of the above-mentioned characteristics.

In another aspect, the present disclosure provides a method of installing a sealing system on a rotor disc having any of the above-mentioned characteristics, the sealing system comprising an annular sealing strip and an annular sealing flange and the method comprising the following steps:

installing the annular sealing strip on the face of the rotor disc;

installing the sealing flange sectors forming the annular flange;

positioning the annular strip in the second groove of the flange; and installing the blades on the rotor disc by inserting their roots into cavities of the rotor disc.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number.

Figure 1:
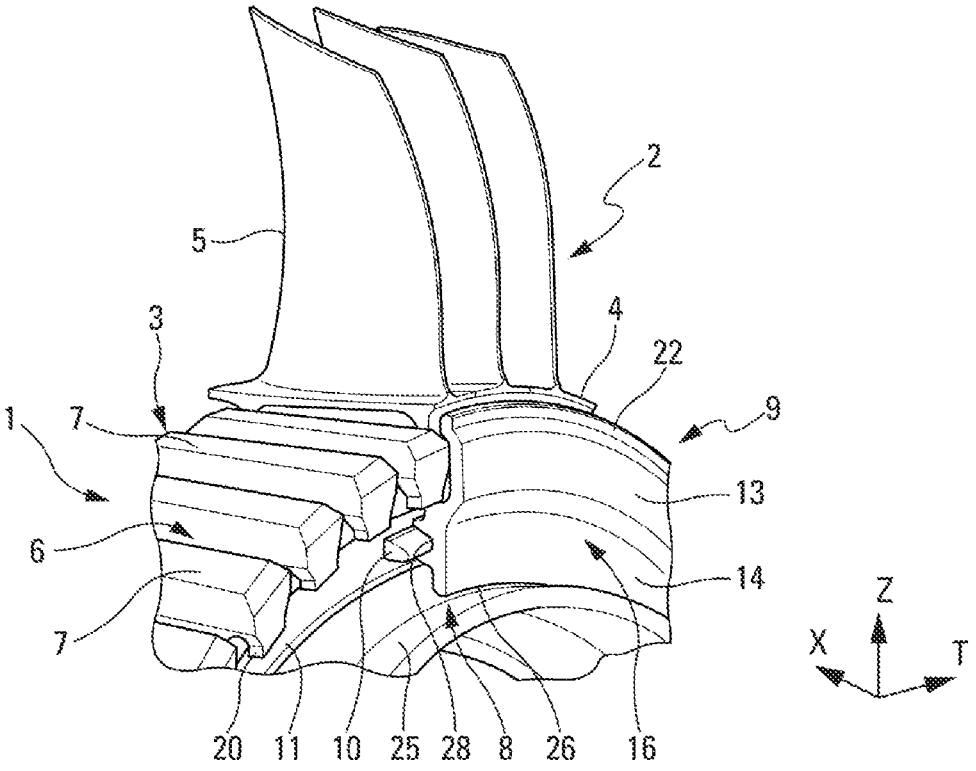
FIG. 1 is a partial schematic and perspective view of a sealing system mounted on a turbomachine rotor disc according a representative embodiment of the present disclosure.

FIG. 1 partially illustrates a turbomachine rotor disc 1, for example a compressor or turbine rotor disc, according to a representative and non-limiting embodiment of the present disclosure. The turbomachine may be an aircraft turbojet, a turboprop engine, or another turbine engine. The rotor disc 1 is centered on a longitudinal axis X of the turbomachine and several blades 2 each extend along a radial axis Z from the periphery 3 of the rotor disc 1. The blades 2 are evenly distributed around the periphery of the rotor disc. Each blade 2 comprises a blade root 4 (hereinafter "root" 4) and a vane 5 which extends along a radial axis from the root 4. Each blade is configured to be bathed (located in) in an aerodynamic flow passing through the turbomachine.

The rotor disc 1 comprises a plurality of cavities 6 which each extend substantially along the longitudinal axis X and which are evenly distributed around the periphery 3 of the rotor disc 1. In some embodiments, the cavities may be arranged in a direction having a non-zero angle to the longitudinal axis (pinning angle).

The cavities 6 are each configured to receive one blade root 4. The cavities 6 are each circumferentially bounded by two teeth 7 as shown in FIG. 1. The roots 4 each have a shape corresponding to that of a cavity 6, such as a fir tree or dovetail shape.

Figure 2:
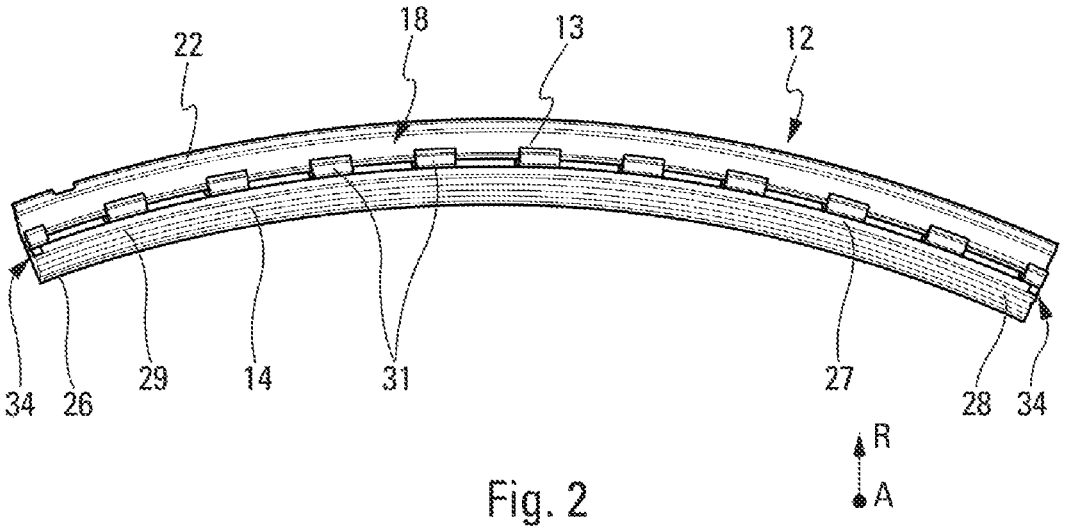
FIG. 2 is a schematic and side view of an example of a sealing flange sector configured to form an annular flange according to a representative embodiment of the present disclosure.

With reference to FIGS. 1 and 2, at least one sealing system 8 is mounted on the rotor disc so as to prevent aerodynamic flow to circulate upstream of the rotor disc. The sealing system 8 comprises an annular sealing flange 9 and an annular sealing strip 10. The annular strip 10, as will be seen in the following description, is mounted (or configured to be mounted) on the annular flange 9 in such a way as to prevent the passage of air under the annular flange.

The annular flange 9 is mounted against one face 11 of the rotor disc 1, which extends along the radial axis Z, so that the blades 2 carried by the rotor disc 1, in particular the roots 4 in the cavities 6, are axially fixed. The annular flange 9 also makes it possible, via the annular strip, to prevent the aerodynamic flow from flowing into the cavities 6 and under the blade roots 4 by forming a sealing barrier.

The face 11 is an upstream or a downstream face of the rotor disc, depending on the stage on which the annular flange 9 is mounted.

Each turbine (like each compressor) comprises one or more stages. In the case of a plurality of stages, these are arranged successively along the longitudinal axis X. Each stage comprises a movable wheel with blades forming a rotor and a fixed wheel forming a stator. The blades of this stator are referred to as distributor blades. Each movable wheel is arranged upstream of a distributor wheel. In the case of a compressor, the stator blades are referred to as rectifier and each of these is respectively downstream of one movable wheel also. Each movable wheel comprises a rotor disc as shown in FIG. 1.

In some embodiments, annular flanges are mounted upstream and/or downstream of the rotor disc.

In the present invention, and in general, the terms "upstream" and "downstream" are defined in relation to the flow of gases in the turbomachine which is substantially parallel to the longitudinal axis X. The terms "axial" and "axially" are defined in relation to the longitudinal axis. A transverse axis T shown in FIG. 1 is also perpendicular to the longitudinal and radial axes.

In this representative embodiment, the flange is located on the downstream face of the disc, and the annular flange 9 comprises several flange sectors 12 such as the one shown in FIG. 2. Each flange sector 12 extends in a circumferential direction around an axial direction A. This axial direction A is centered on the longitudinal axis X of the rotor disc and the turbomachine in the installed condition.

Each flange sector comprises a radially outer part 13 and a radially inner part 14 which each extend respectively in a radial direction R. The terms "inner," "outer," "radial," and "radially" are defined with respect to the radial direction R perpendicular to the axial direction A and with respect to the distance from the axial direction A. Similarly, in the situation where the flange is installed on the turbomachine disc, the radial direction R is parallel to the radial axis Z.

Each flange sector 12 also comprises an upstream face 15 and a downstream face 16 which are opposite in the axial direction (and along the longitudinal axis X in the case of installation on the rotor disc).

Figure 3:
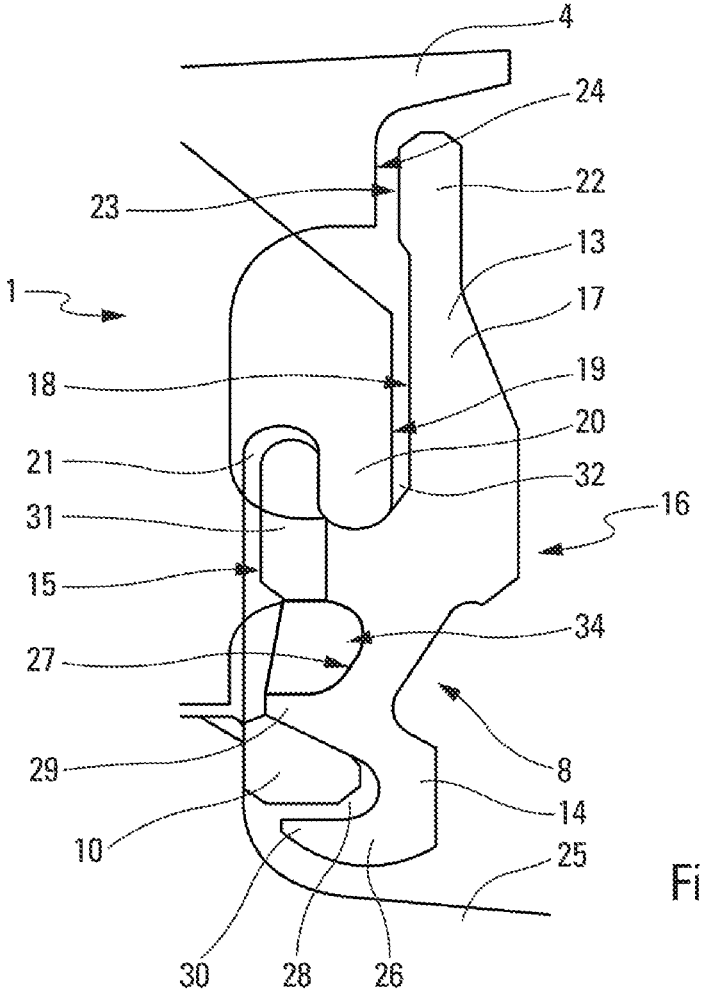
FIG. 3 is a detailed and axial sectional view of an example of a flange sector equipped with a foolproofing element and mounted on a rotor disc according to a representative embodiment of the present disclosure.

With reference to FIGS. 2 and 3, the radially outer part 13 is configured to be applied to the blade roots to ensure sealing. In particular, the radially outer part 13 comprises a first wall 17 having a first surface 18 which is defined in a plane which is substantially perpendicular to the axial direction A. The first surface 18 faces at least one (substantially flat) bearing surface 19 of a hook 20. The latter is carried by each tooth 7 of the rotor disc. In other words, there is a plurality of hooks 20 which are distributed around the longitudinal axis. The hooks 20 extend radially towards the longitudinal axis (i.e. inwards). The hooks are spaced axially from the face of the disc forming an annular groove 21.

The radially outer part 13 also comprises a peripheral lip 22 which extends radially from the first wall 17 of the flange sector 12. The peripheral lip 22 has a second surface 23 which is configured to bear against at least one root 4 of blade 2, and in particular against a bearing surface 24 of each blade root. The second surface 23 is defined in a plane substantially parallel to that of the first surface 18 of the first wall 17 of the flange sector 12. The first and second surfaces are located on the side of the upstream face 15 of the flange sector 12. In particular, as can be seen in FIG. 3, the second surface 23 is upstream of the first surface 18, allowing contact between the second surface 23 and the bearing surface 24.

With reference to FIGS. 2 and 3, the radially inner part 14 comprises a peripheral edge 26 formed at the radially inner end of the flange sector and facing a hub 25 of the rotor disc. The radially inner part comprises a first groove 27 configured to be arranged opposite the rotor disc face 11. In other words, the first groove 27 is arranged on the upstream face 15 of the flange sector 12. The first groove is elongated in a circumferential direction. This first groove 27 reduces the weight of the flange sector 12, thereby improving the performance of the compressor or turbine and the service life of the turbine (or compressor).

The radially inner part 14 is supplemented by a second groove 28 configured to be arranged also opposite the face 11 of the rotor disc. In other words, the first groove 28 is arranged on the upstream face 15 of the flange sector 12. In some embodiments, the first groove is disposed radially outside the second groove. The second groove also extends in a circumferential direction. The first groove 27 is arranged radially outside the second groove 28.

In particular, the second groove 28 is configured to receive at least part of the annular sealing strip 10 (or ring). The annular strip 10 is split radially. More specifically, the annular strip prevents the aerodynamic flow from rising to the disc cavities 6. In this representative embodiment, the annular strip has a trapezoidal cross-section. However, in some embodiments, the annular strip 10 has an approximately triangular cross-section.

The first and second grooves 27, 28 each extend circumferentially over the entire surface of the flange sector. Each first and second groove has a U-shaped axial section with a bottom and two substantially axial branches extending from the bottom. Likewise, each first groove and second groove extends between a first end and a second opposite end in the circumferential direction of elongation.

As can be seen in FIGS. 1 and 3, the first and second grooves are radially separated by an annular projection 29 extending axially from the upstream face 15 of the flange sector. The annular projection 29 also extends over the entire surface of the flange sector in the circumferential direction. The peripheral edge 26 furthermore comprises a pin 30 which makes it possible to form one of the branches of the U of the second groove 28.

Each flange sector 12 in this representative embodiment also comprises a plurality of lugs 31 (or flange hooks) which are evenly distributed on the upstream face 15 of the flange sector in a circumferential direction. These lugs 31 project from the upstream face and extend radially outwardly, and are configured to cooperate with the hooks 20 of the rotor disc carried by the teeth so as to form an axial and radial retention of the flange sector in relation to the rotor disc. For example, the lugs 31 have shapes and dimensions substantially complementary to the annular groove 21 in which they are configured to be housed. In this representative example, the lugs 31 are arranged radially between the radially outer part 13 and the radially inner part 14. The lugs 31 are spaced axially from the upstream face so as to form a third groove 32 in which the hooks 20 are received.

Figure 4:
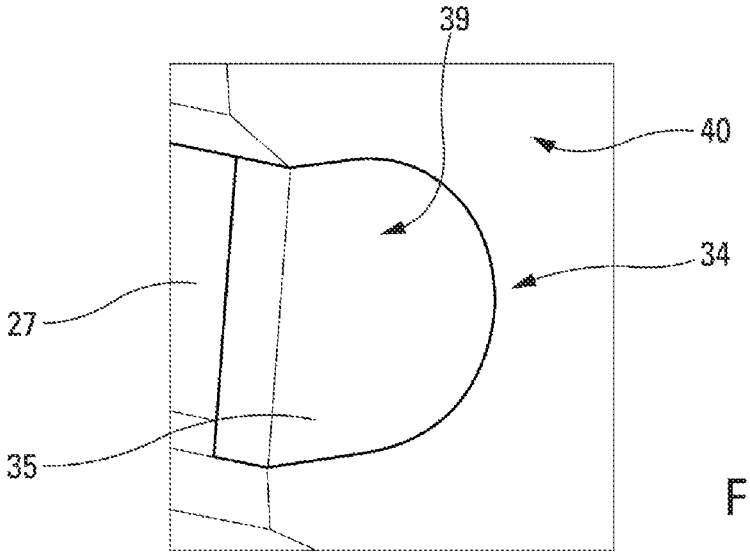
FIG. 4 shows an example of a foolproofing element arranged in a sealing flange sector according to a representative embodiment of the present disclosure.

As can be seen in FIGS. 2, 3 and 4, the first groove 27 comprises at least one foolproofing element 34 so as to prevent the mounting of the annular strip 10 in it.

In this representative example, one foolproofing element 34 is arranged at each circumferential end of the first groove.

Advantageously, but not restrictively, at least one foolproofing element 34 comprises a protuberance 35 projecting from the bottom of the first groove 27. In this representative example, the protuberance 35 is integrally formed with the flange 9, 12. This configuration is simple to implement because it is sufficient to interrupt the machining operation of the first groove at the desired position for the foolproofing element. When the protuberances 35 are located at the ends of the first groove 27, it is sufficient to stop the machining operation earlier. Such a solution has a very small impact on the mass of the flange. On the other hand, this solution is simple since it is applied during the machining of the flange. In some embodiments, the at least one foolproofing element 34 consists of a protuberance 35 projecting from the bottom of the first groove 27.

Another advantage is that each protuberance 35 has a small thickness so that the flange mass can be checked. For example, each protuberance 35 has a thickness (in the circumferential direction) of between 0.5 mm and 2.0 mm.

Each protuberance has a height less than or equal to that of the first groove 27 substantially in the axial direction A. This guarantees the sealing of the flange.

As can be seen in FIG. 4, the protuberance has a face 39 which is flush with a side face 40 of the flange sector.

In some embodiments, each flange sector is made of a metallic material or a metal alloy. Advantageously, the metal material or metal alloy comprises a base of nickel, chromium, iron and/or molybdenum.

A representative and non-limiting method for mounting a sealing system 8 on a rotor disc 1 as described above is now described. The sealing system comprises an annular sealing flange 9 and also an annular sealing strip 10. In this representative mounting method, the operator first installs the annular sealing strip on the face 11 of the rotor disc. The flange sectors 12 are then placed on the rotor disc to form the flange 9. In some embodiments, the flange 9 is formed in one piece, forming a closed ring.

In this step, the lugs 31 of each sector 12 are slid into the annular groove 21 formed by the hooks 20 of the rotor disc. Each hook 20 is also housed in the third groove 32 of the flange sector.

In the same way, during this step, the annular strip 10 is positioned at a desired height in the radial direction so that it can be inserted into the second groove 28. The operator cannot make a mistake in the choice of groove since the first groove 27 comprises at least one foolproofing element to prevent the insertion of the strip 10. Then, the blades 2 are mounted on the disc by inserting the blade roots into the cavities.

As the rotor disc rotates, the flange sectors 12 move radially outwards under centrifugal force so that the peripheral lip 22 of each flange sector 12 is in contact with the blade root 4. The free ends of the hooks 20 may abut against the bottom of the third groove 32 and/or the free ends of the lugs 31 may abut against the bottom of the annular groove 21. The second surface 23 of the peripheral lip also comes into contact with the contact surface 24 of the blade root by tilting around a point of contact with the disc hooks 20. This enables axial and radial locking of the annular flange 9 and also of the blade. The complete sealing of the system (rotor disc—annular strip—annular flange—blade) is thus ensured.

When the rotor disc is stationary, the flange 9 is no longer subject to centrifugal force and is held by the annular strip 10 (due to the inherent rigidity of the annular strip 10) on the rotor disc 1.

While illustrative embodiments have been illustrated and described, it will be appreciated that various changes can be made therein without departing from the spirit and scope of the claimed subject matter.

The invention claimed is:

1. A sealing flange sector for a turbomachine rotor disc which carries blades, the sealing flange sector comprising:

a radially outer part which is configured to be applied at least partly on the blades to ensure sealing between the blades; and a radially inner part configured to bear against an annular strip mounted on a face of the turbomachine rotor disc, the radially inner part comprising a first groove and a second groove, said first groove being disposed radially outside said second groove, wherein the sealing flange sector comprises a foolproofing element which is rigidly arranged inside the first groove and which avoids insertion of the annular strip inside the first groove.

2. The sealing flange sector according to claim 1, wherein the first groove comprises two opposite ends along a circumferential direction of elongation of the first groove, the foolproofing element being arranged at least one of the two opposite ends of the first groove.

3. The sealing flange sector according to claim 1, wherein each foolproofing element comprises a protuberance projecting from a bottom of the first groove.

4. The sealing flange sector according to claim 3, wherein the protuberance is integrally formed with the sealing flange sector.

5. The sealing flange sector according to claim 1, wherein the radially outer part comprises a peripheral lip configured to come against a blade root.

6. The sealing flange sector according to claim 1, further comprising a plurality of lugs arranged radially between the radially inner part and the radially outer part, each lug extending radially outwardly.

7. The sealing flange sector according to claim 1, wherein the first groove and the second groove are arranged on an upstream face of the sealing flange sector.

8. The sealing flange sector according to claim 7, wherein the first and second grooves are radially separated by an annular projection extending axially from the upstream face of the sealing flange sector.

9. An annular flange comprising a plurality of the sealing flange according to claim 1.

10. A turbomachine rotor disc carrying blades and equipped with the annular flange according to claim 9 and with an annular sealing strip installed in the second groove of each flange sector.

11. A turbomachine comprising the turbomachine rotor disc according to claim 10.

12. An annular flange comprising a plurality of the sealing flange sectors according to claim 2.

13. An annular flange comprising a plurality of the sealing flange sectors according to claim 3.

14. An annular flange comprising a plurality of the sealing flange sectors according to claim 4.

15. An annular flange comprising a plurality of the sealing flange sectors according to claim 5.

16. An annular flange comprising a plurality of the sealing flange sectors according to claim 6.

17. An annular flange comprising a plurality of the sealing flange sectors according to claim 7.

18. An annular flange comprising a plurality of the sealing flange sectors according to claim 8.

19. The sealing flange according to claim 1, wherein the first groove and the second groove extend along a circumferential direction.

20. The sealing flange according to claim 1, wherein the sealing flange is formed in one piece.

* * * * *